US011857021B1

(12) United States Patent
Wright

(10) Patent No.: US 11,857,021 B1
(45) Date of Patent: Jan. 2, 2024

(54) VENTILATED HAT INSERT

(71) Applicant: Bryan Wright, San Jose, CA (US)

(72) Inventor: Bryan Wright, San Jose, CA (US)

( * ) Notice: Subject to any disclaimer, the term of this patent is extended or adjusted under 35 U.S.C. 154(b) by 405 days.

(21) Appl. No.: 16/788,243

(22) Filed: Feb. 11, 2020

Related U.S. Application Data

(60) Provisional application No. 62/803,802, filed on Feb. 11, 2019.

(51) Int. Cl.
*A42C 5/02* (2006.01)
*A42C 5/04* (2006.01)
*A42B 1/24* (2021.01)

(52) U.S. Cl.
CPC ..... *A42C 5/04* (2013.01); *A42B 1/24* (2013.01); *A42C 5/02* (2013.01)

(58) Field of Classification Search
CPC .... A42C 5/04; A42C 5/02; A42B 1/24; A42B 1/0189; A42B 1/019; A42B 1/0192; A42B 1/011; A42B 1/205; A42B 1/208; A42B 3/10; A42B 3/12; A42B 3/125; A42B 3/127; A42B 3/28; A44B 18/0003; A44B 18/00; A44D 2203/00
USPC ..... 2/181.6, 182.3, 182.8, 267, 268; 24/442, 24/450
See application file for complete search history.

(56) References Cited

U.S. PATENT DOCUMENTS 121,995 A * 12/1871 Dale ..... A42C 5/04 2/182.3
234,846 A * 11/1880 Bancroft ..... A42C 5/04 2/182.3
248,396 A * 10/1881 Dennis ..... A42C 5/02 2/181
622,765 A * 4/1899 Goldman ..... A41D 27/26 2/268
810,332 A * 1/1906 Grean ..... A41D 27/26 2/268
849,007 A * 4/1907 Miller ..... A42C 5/04 2/182.7
968,369 A * 8/1910 Lauermann ..... A42C 5/04 2/181.6
1,503,287 A * 7/1924 Pizzutiello ..... A42C 5/04 2/209.7
3,276,038 A * 10/1966 Fekete ..... A42B 1/06 2/181.2
5,327,585 A * 7/1994 Karlan ..... A42C 5/04 2/209.13
5,369,853 A * 12/1994 Okawa ..... A44B 18/003 24/446
5,481,760 A * 1/1996 Wood, Jr. ..... A42B 1/0181 2/181.6
6,138,280 A * 10/2000 Bae ..... D04H 1/4374 2/181.2
2002/0069452 A1* 6/2002 Knappl ..... A42B 3/00 2/411

(Continued)

FOREIGN PATENT DOCUMENTS

GB 752643 A * 7/1956

*Primary Examiner* — Amy Vanatta
(74) *Attorney, Agent, or Firm* — Pillsbury Winthrop Shaw Pittman LLP

(57) ABSTRACT

An insert for shaping and protecting headwear may include an elongate body shaped to fit along at least a portion of an interior surface of the headwear; and at least one ventilation orifice extending through the elongate body, wherein the elongate body comprises a pressed and/or needled wool felt material.

27 Claims, 9 Drawing Sheets

(56) References Cited

U.S. PATENT DOCUMENTS

| | | | | |
|---|---|---|---|---|
| 2008/0163406 | A1* | 7/2008 | Solari | A42B 1/22 2/195.3 |
| 2012/0036613 | A1* | 2/2012 | Calon | A42C 5/02 2/171 |
| 2013/0205470 | A1* | 8/2013 | Johnson | A42C 5/02 2/181.4 |
| 2016/0255897 | A1* | 9/2016 | Johnson | A61F 13/622 |
| 2021/0112908 | A1* | 4/2021 | Soibelman | A42C 5/02 |
| 2022/0007776 | A1* | 1/2022 | Andersson | A42C 5/04 |
| 2022/0087354 | A1* | 3/2022 | Woods-Malmuth | A42C 5/02 |

* cited by examiner

VENTILATED HAT INSERT

CROSS-REFERENCE TO RELATED APPLICATIONS

The present application claims priority from U.S. Provisional Patent Application No. 62/803,802, titled VENTILATED HAT INSERT filed on Feb. 11, 2019, which is incorporated herein by reference in its entirety.

TECHNICAL FIELD

The disclosed embodiments relate to headwear, and more particularly, to a ventilated hat insert for shaping and protection of headwear, such as baseball caps, and methods of attaching the insert to various headwear.

BACKGROUND

Existing hat inserts are not designed to protect the headwear. Rather, they are only designed to shape the headwear. Specifically, the existing devices are made of a non-porous foam or leather, which traps body heat, in turn causing excess sweating and accumulating body odor in the hat, or they are made of a paper-based or cloth material that rapidly deteriorates and does not hold its shape or absorbance. As such, the existing devices, while potentially useful for shaping a hat, are not designed to prevent sweat absorption into the hat. Specifically, existing devices are made of non-porous foam or leather.

SUMMARY

Some embodiments of the present disclosure include a device (e.g., an insert or attachment) for shaping and protecting headwear. The device protects the hat from, for example, sweat, oils, make up, skin products, hair products, and the like. The device may include an elongate body shaped to fit along at least a portion of an interior surface of the headwear, and may include at least one ventilation orifice extending through the elongate body. In some embodiments, the elongate body is made of an absorptive compacted fibrous material (e.g., a pressed and/or needled wool felt material) that may be naturally moisture and oil absorbing and, as such, may prevent excess sweat, oils, make up, skin products, hair products, and the like from actually touching or getting into the hat by trapping it inside the absorptive compacted fibrous material.

Various other aspects, features, and advantages of the disclosed embodiments will be apparent through the detailed description and the drawings attached hereto. It is also to be understood that both the foregoing general description and the following detailed description are examples and not restrictive of the scope of the disclosed embodiments. As used in the specification and in the claims, the singular forms of "a," "an," and "the" include plural referents unless the context clearly dictates otherwise. In addition, as used in the specification and the claims, the term "or" means "and/or" unless the context clearly dictates otherwise.

DETAILED DESCRIPTION

In the following description, for the purposes of explanation, numerous specific details are set forth in order to provide a thorough understanding of the embodiments. It will be appreciated, however, by those having skill in the art that the embodiments may be practiced without these specific details or with an equivalent arrangement. In other cases, well-known structures and devices are shown in block diagram form in order to avoid unnecessarily obscuring the embodiments.

Figure 1:
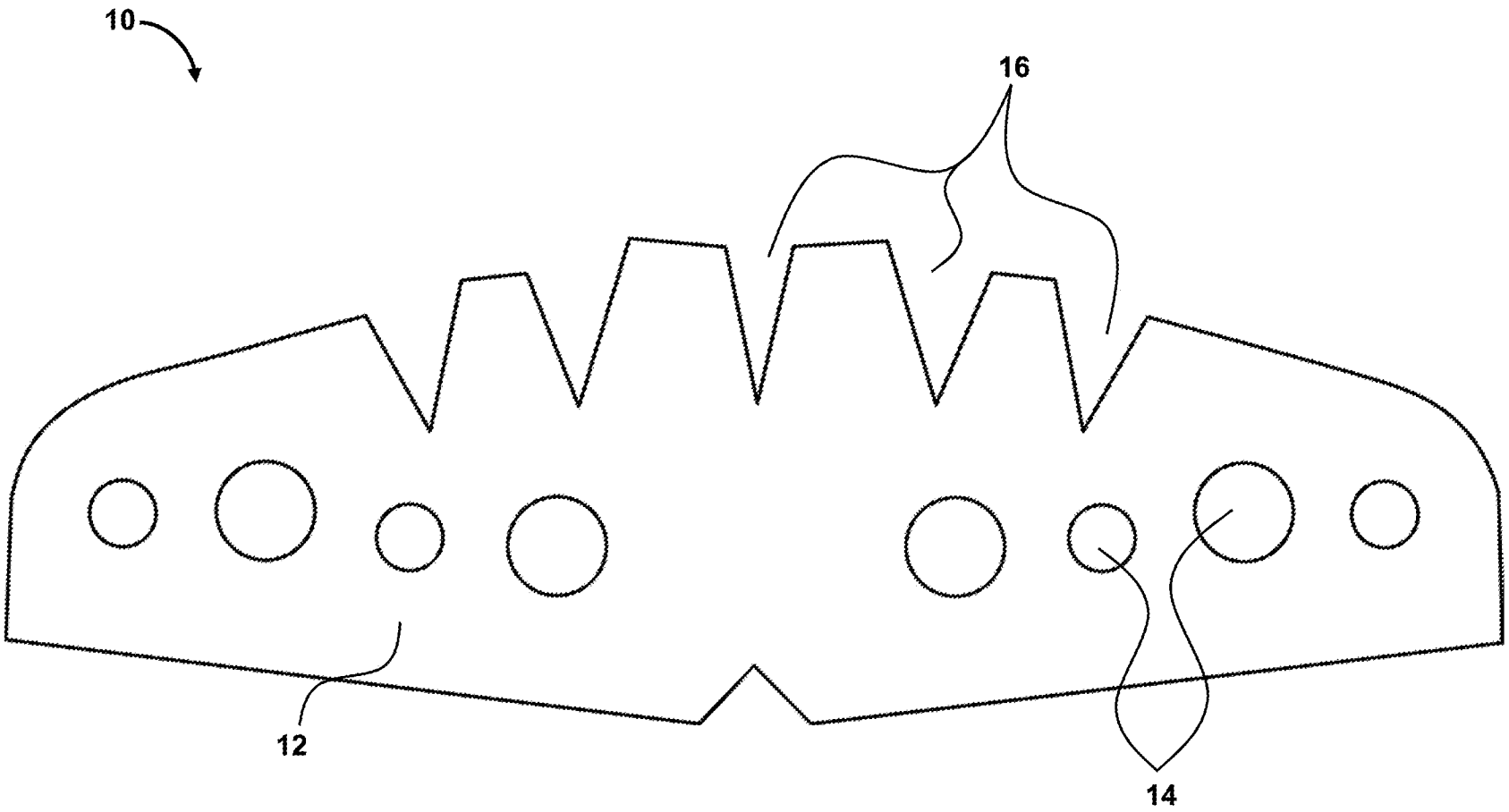
FIG. 1 shows a device for shaping and protecting headwear, consistent various embodiments.

FIG. 1 shows a device for shaping and protecting headwear, consistent various embodiments. The device 10 may be used as a device for shaping and protecting headwear, such as a hat, and may include an elongate body 12 having a ventilation orifice 14. The elongate body 12 may be shaped to fit along at least a portion of an interior surface of the headwear such as a hat. The elongate body 12 can include ventilation orifice 14 extending through the elongate body 12. The elongate body 12 may also include multiple shaping notches 16 on upper and lower edges thereof, which may help the device 10 stay flat against the interior of the headwear and against the head of a wearer of the headwear, even when rounded to mimic the shape of the headwear and the wearer's head. Thus, these notches 16 may help prevent folding of the elongate body 12 during use.

Figure 2:
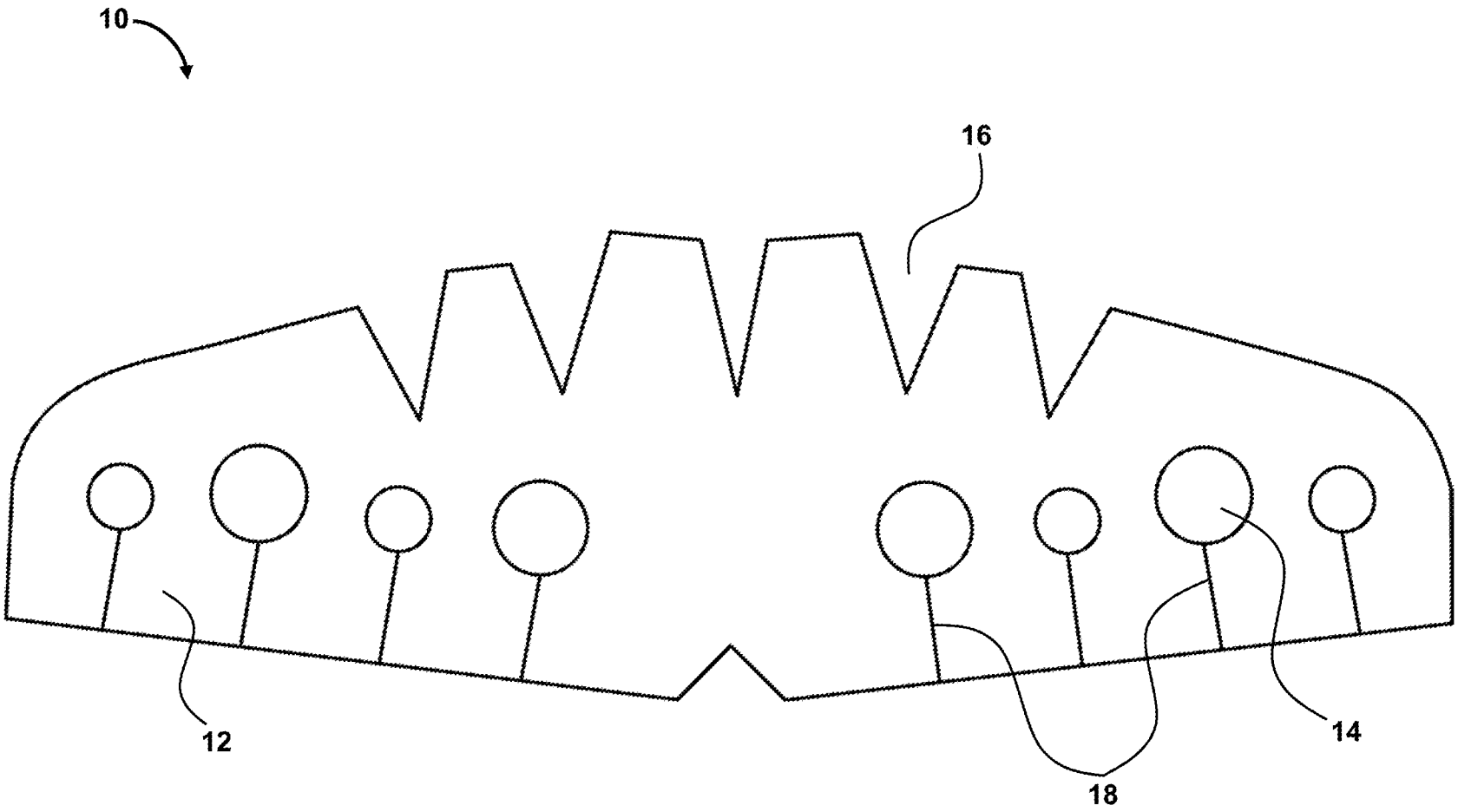
FIG. 2 shows another device for shaping and protecting headwear, consistent various embodiments.

The elongate body 12 may include one or more ventilation orifices 14. The ventilation orifices 14 may help enhance ventilation and thus, minimize sweating of the wearer. While the ventilation orifices 14 are shown as circular in shape, the ventilation orifices 14 are not limited to being circular in shape. Rather, the ventilation orifices 14 may have any desired shape or size. FIG. 2 shows another device for shaping and protecting headwear, consistent various embodiments. In some embodiments, and as shown in FIG. 2, the ventilation orifices 14 may extend downward to the lower edge of the elongate body 12 or may have slits 18 extending downward from the orifices 14 to the lower edge of the elongate body 12. Such slits 18 may allow for the positioning of the device 10 in such a way that the bottom edge hugs a band in the hat, resulting in the device 10 itself being positioned between the wearer's head and the band, further reducing the likelihood that oils, sweat, and the like are transferred from the wearer's head to the hat.

The elongate body 12 may be made of any of a number of absorptive compacted fibrous materials that is comfortable to wear (e.g., soft on user's skin), enhances ventilation (e.g., minimizes sweating) and is fire retardant. As an example, the elongate body may be made of a pressed wool felt material. Because wool is naturally antibacterial, use of such a material may prevent the buildup of unpleasant odors from prolonged or repeated hat wearing. The wool may also be naturally moisture and oil wicking and, as such, may prevent excess sweat from actually touching or getting into the hat by trapping it inside the woven wool fibers. While pressed wool felt is mentioned above, other similar and suitable absorptive compacted fibrous materials, such as needled wool felt, merino wool, synthetic wool, blended fire-retardant fibers, or any other absorptive compacted fibrous material, may be used to make the device 10. The device 10 can be made of Society of Automotive Engineers (SAE) (e.g., US Federal Specification C-F-206G) compliant and non-SAE materials. In some embodiments, any SAE application of the device 10 may use fibers that are Restriction of Hazardous Substances (ROHS) compliant and fire resistant (e.g., FMVSS-302, FMVSS-218, or other federally mandated motor vehicle safety standard for fibers; likewise, other embodiments may require use of military standards such as American Society for Testing and Materials (ASTM), International Organization for Standardization (ISO), National Fire Protection Association (NFPA) or other standards used to define flame retardant qualities in the US military and those of militaries in other countries). The fiber blends may contain: one or more of wool fibers, silver fibers, bamboo fibers, or synthetic fibers, or blends of one or more fibers. The device 10 can be made in any color.

The dimensions of the device 10 may depend on the type of hat the device 10 is used with. In some embodiments, the device 10 may have a sufficient thickness to be useful in reshaping wilted or unstructured hat crowns to a uniform and clean appearance. As an example, the thickness of the device 10 can be in the range of one eighth "⅛" of inch to-one thirty-second ("1/32") of an inch. As an example, the device 10 with thickness "1/32" inch may be used in hats that are not size-adjustable (e.g., cowboy hats, military dress hats, drill sergeant hats, or other hats).

In some embodiments, a height of the device 10 may be shorter for hardhat applications and visor applications. As another example, for full hat applications, the device 10 may have full-circumference interior headband coverage with a height of one inch to two inches. The width of the device 10 can range anywhere from a full circumference of the hat to which the device 10 is attached to a portion of the full circumference (e.g., wide enough to cover a forehead of the wearer such as from ear to ear).

Figure 3:
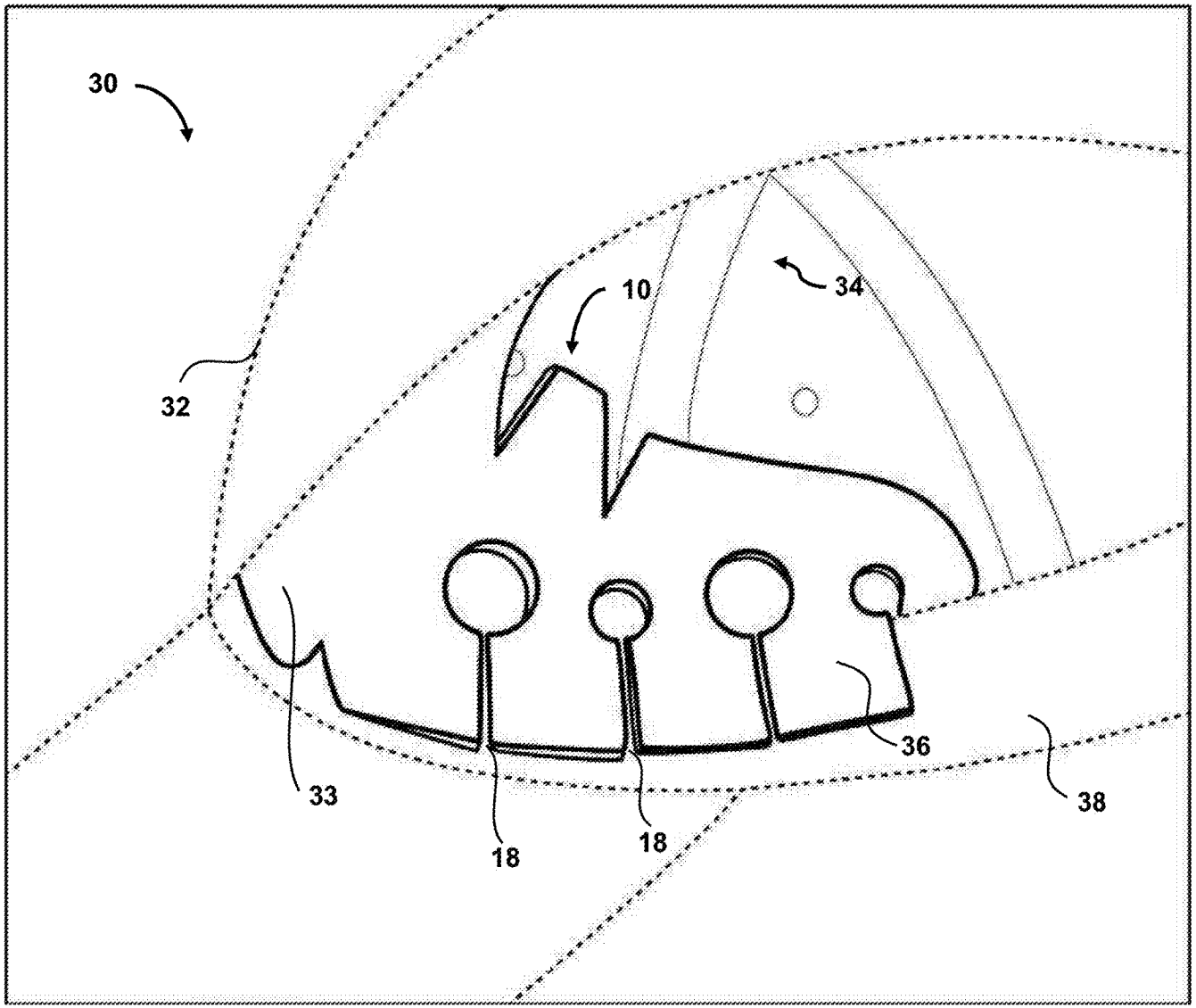
FIG. 3 shows a first view of a device installed in a hat, consistent with various embodiments.
Figure 4:
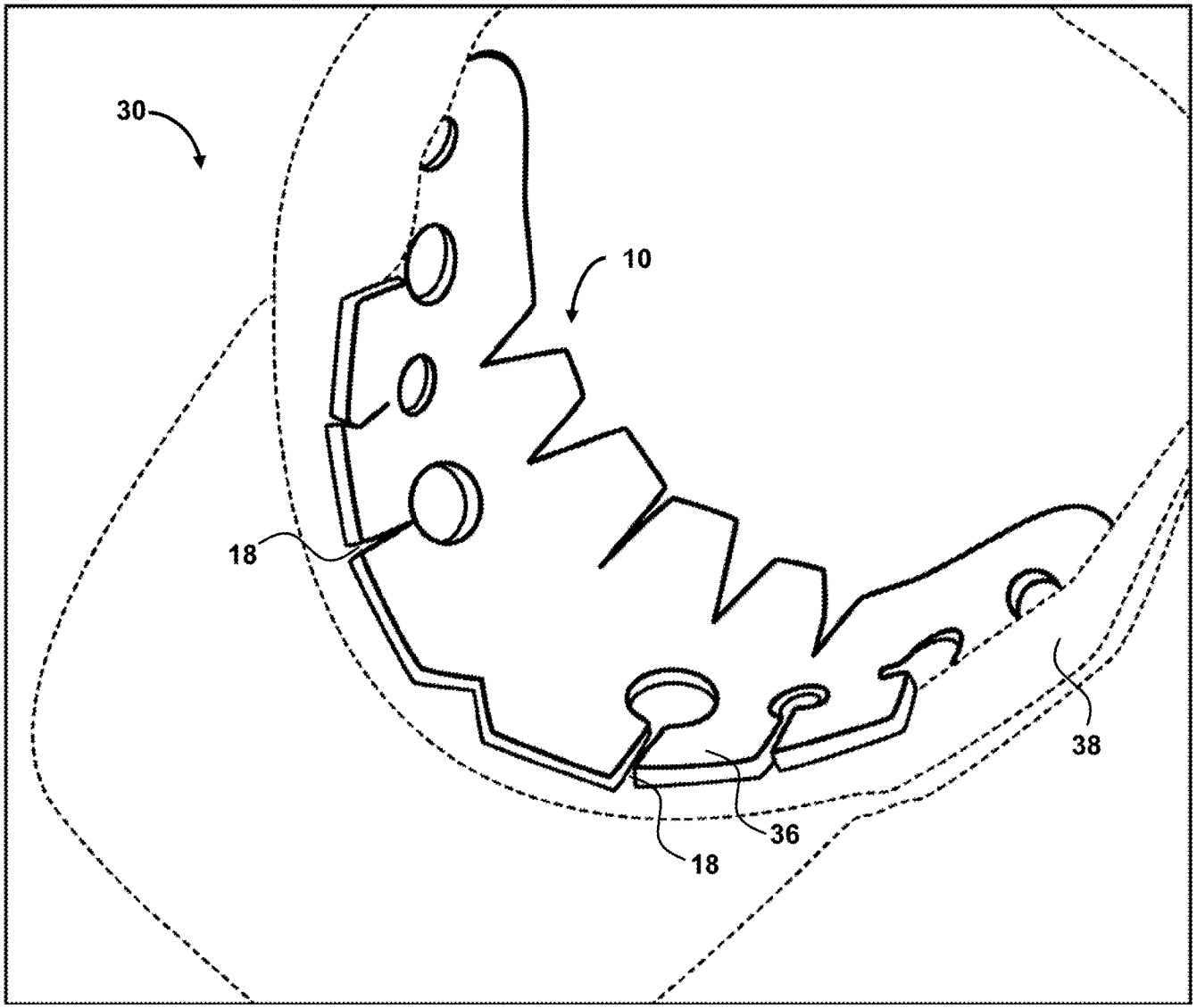
FIG. 4 shows a second view of a device installed in the hat, consistent with various embodiments.

To use the device 10, the device 10 may be placed inside the headwear. FIGS. 3 and 4 show the device 10 installed in headwear such as a hat, consistent with various embodiments. The device 10 includes an "away" surface (e.g., away surface 53 of FIG. 5) and a "near" surface (e.g., near surface 33) in which the away surface 53 faces away from a head of a wearer and towards the interior surface of the headwear, and the near surface 33 faces the head of the wearer when worn by the wearer. In some embodiments, the near surface 33 may include information, such as brand information (e.g., text or image). The device 10 may be positioned in a crown portion 32 of the hat 30 such that the away surface 53 of the device 10 is facing an interior surface 34 of the hat 30. As an example, one or more tabs 36 created by slits 18 of the ventilation orifices may be placed inside or tucked in an interior band 38 (such as the front interior band) of the hat 30 to hold the device 10 in place. The device 10 may be positioned such that the bottom edge along with the ventilation orifices 14 hug the interior band 38. The wearer may then wear the hat 30 as normal, wherein the device 10 may protect the hat 30 from the wearer's sweat, body oils, and the like.

Figure 5:
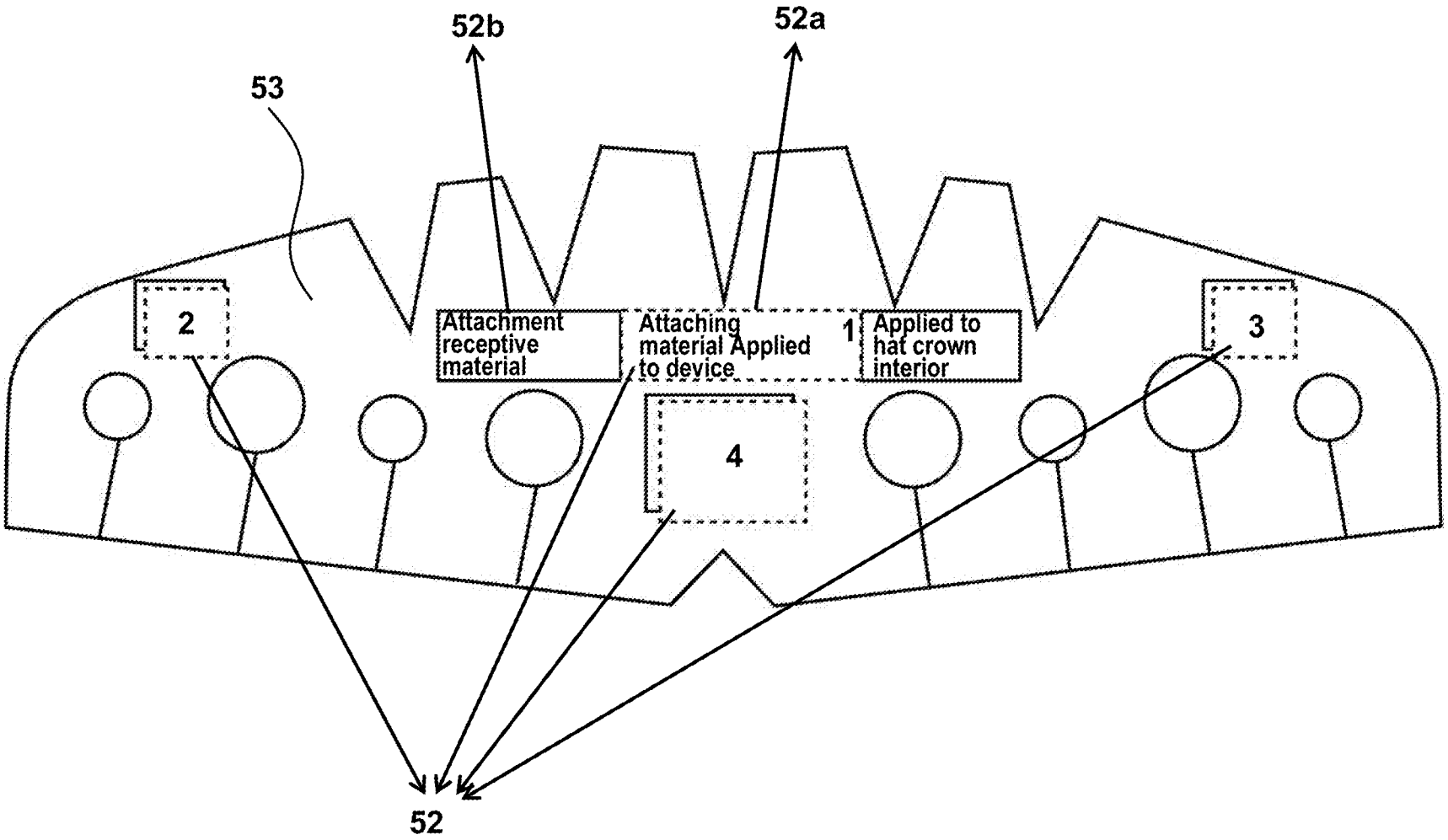
FIG. 5 shows a first fastener to install a device in a headwear, consistent with various embodiments.
Figure 6:
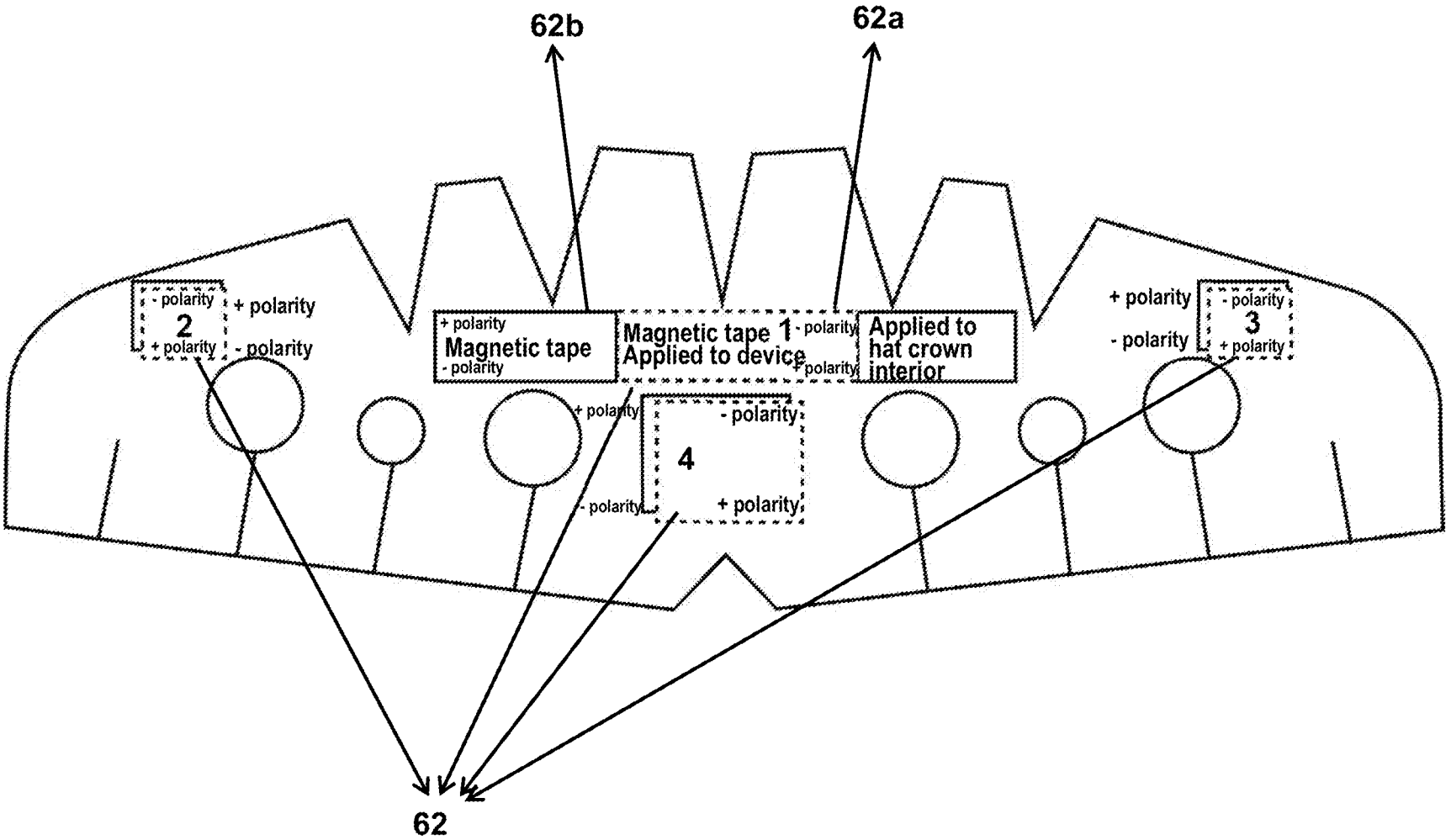
FIG. 6 shows a second fastener to install a device in a headwear, consistent with various embodiments.
Figure 7:
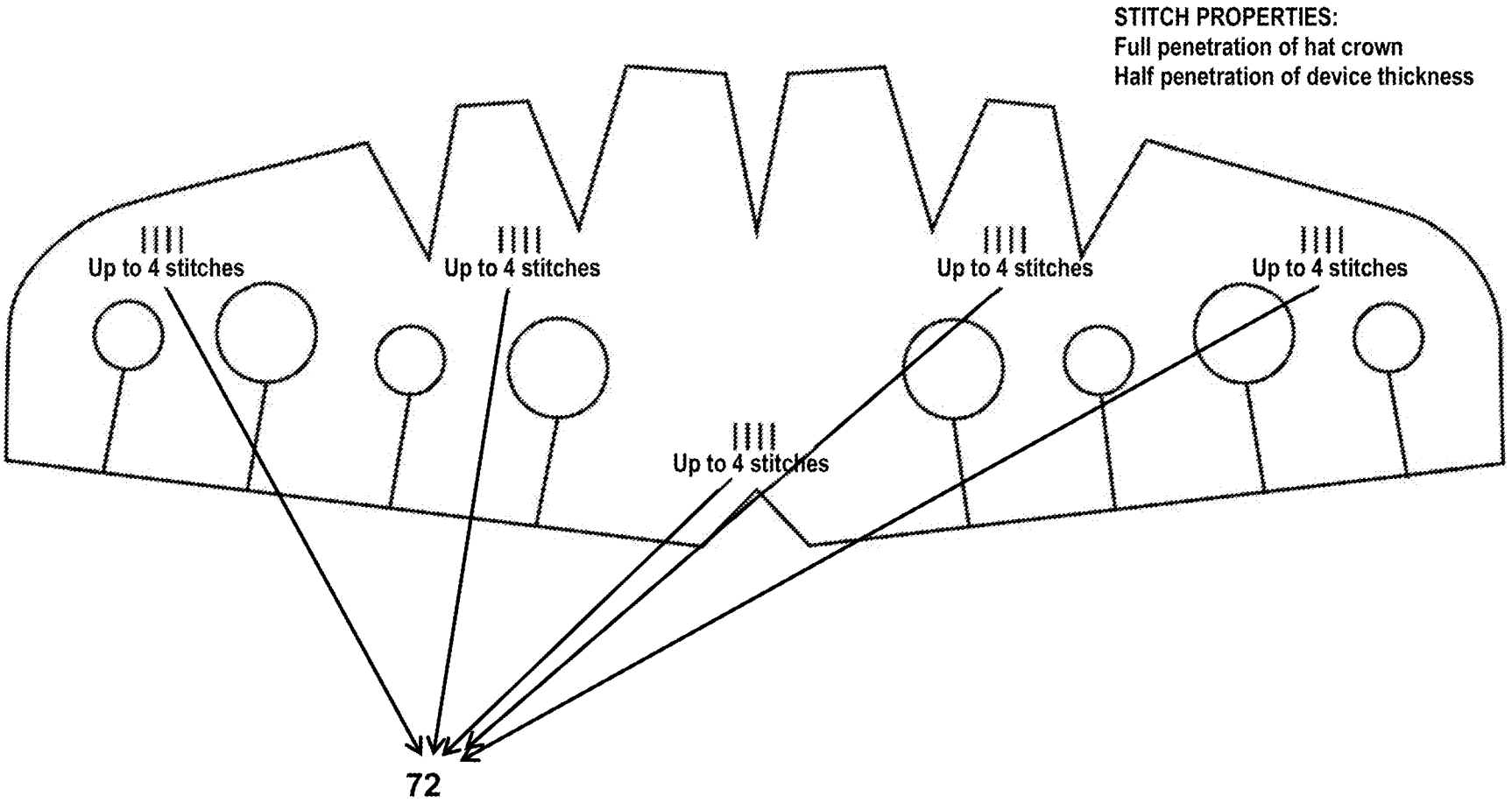
FIG. 7 shows a third fastener to install a device in a headwear permanently, consistent with various embodiments.

In some embodiments, the device 10 can include a fastener to attach the device 10 to the headwear. The fastener can attach the device 10 to the headwear detachably or permanently. The fastener can be used in addition to or alternative to tucking in the tabs 36 of the device 10. As an example, FIGS. 5-7 show various fasteners used to attach the device 10 to headwear, such as the hat 30. The fasteners of FIGS. 5 and 6 may be used to removably or detachably attach the device 10 to headwear, and the fastener of the FIG. 7 may be used to attach the device 10 to headwear permanently.

FIG. 5 shows a first fastener to install a device in a headwear, consistent with various embodiments. As shown in FIG. 5, the first fastener 52 may be a hook and loop fastener that is used to detachably attach, fit or install the device 10 in headwear such as the hat 30. The first fastener 52 may include two portions—a set of hooks 52*a* and a set of loops 52*b* (e.g., such as the ones manufactured by Velcro). The set of hooks 52*a* may be attached to the device 10 and the set of loops 52*b* may be attached to the hat 30. The hook and loop fasteners may be attached to the device 10 and the hat 30 at one or more points (referred to as "attachment points"). As an example, and as shown in the FIG. 5, the hook and loop fasteners may be attached at four attachment points (e.g., attachment point "1"-attachment point "4"). The set of hooks 52*a* may be attached to the device 10 at the attachment points on the away surface 53, and the opposing set of loops 52*b* may be attached to the hat 30 at the attachment points on the interior surface 34 in the crown portion 32. The device 10 can be installed in the hat 30 by attaching the set of hooks 52*a* to the set of loops 52*b*.

The hook and loop fasteners may provide an attachment of low to moderate grip strength. The hook and loop fasteners may be attached to the device 10 and the hat 30 using an adhesive. In some embodiments, the adhesive may have very high permanent grip strength and be designed for use with synthetic fiber, fabric, and/or felted textile substrate. Other methods of attaching the hook and loop material may also be used. As an example, the hook material may be sewn in to the device 10 and the loop material may attached to the device 10 using the adhesive.

In some embodiments, the dimensions of a hook material are different from that of the loop material. As an example, the hook material ("attaching material") is of a shorter length than the opposing loop material ("attachment receptive material") (e.g., half the length of the loop material) applied inside the hat 30. In some embodiments, having the attaching material smaller than the attachment receptive material minimizes the damage that may be caused to the device 10 due to the force with which the device 10 may be removed from the hat 30, thus enhancing removability of the device 10. Further, having loops of lengths different from that of the hooks may allow adjustable device positioning within the hat 30.

The number of hooks and loops used may vary (e.g., based on the material of the device 10 or the hat 30). As an example, the number of hooks and loops is the same. As another example, the number of hooks may be more than the number of loops (e.g., a number of hooks may lock into a single loop that is of longer length than the hooks).

While the foregoing paragraphs describe the set of hooks 52*a* as being attached to the device 10 and the set of loops 52*b* being attached to the hat 30, in some embodiments, the set of loops 52*b* may be attached to the device 10 and the set of hooks 52*a* may be attached to the hat 30.

In some embodiments, the first fastener 52 may be a magnetic fastener, which allows the device 10 to be detachably attached to the hat 30. As an example, a first portion of the magnetic attachment can be a non-magnet metal tape (e.g., a magnetically receptive steel tape or other metal tapes that are attracted to a magnet) and a second portion of the magnetic attachment can be a magnetic tape (e.g., made of magnet). The non-magnet metal tape can be attached to the hat 30 at one or more attachment points on the interior surface 34 of the hat 30, and the magnetic tape can be attached to the device 10 at one or more attachment points on the away surface 53 of the device 10 (e.g., in a way similar to the hook and loop fasteners illustrated in FIG. 5). The device 10 may be attached to the hat 30 by attaching the magnetic tape on the device 10 to the non-magnet metal tape on the hat 30. The magnetic attachment may allow precise device repositioning within the hat 30.

The non-magnet metal tape and the magnetic tape may be attached to the hat 30 and the device 10, respectively, using an adhesive. The magnetic tape may be high-gauss magnetic tape (e.g., gauss value above a specified threshold) that holds the device 10 firmly in position but also allows easy removability.

While the foregoing paragraphs describe the non-magnet metal tape being attached to the interior surface 34 of the hat 30 and the magnetic tape being attached to the device 10, in some embodiments, the non-magnet metal tape may be attached to the device 10 and the magnetic tape may be attached to the hat 30.

FIG. 6 shows a second fastener to install a device in a headwear, consistent with various embodiments. As shown in FIG. 6, the second fastener 62 may be a magnetic fastener that is used to detachably attach the device 10 in headwear such as the hat 30. The second fastener 62 may include two portions—a first set of magnetic tapes 62*a* of a first polarity and a second set of magnetic tapes 62*b* of a second polarity opposite the first polarity. The first set of magnetic tapes 62*a* may be attached to the device 10 and the second set of magnetic tapes 62*b* may be attached to the hat 30, or vice versa. The magnetic tapes may be attached to the device 10 and the interior surface 34 of the hat 30 at one or more attachment points on away surface 53 of the device 10 and the interior surface 34 of the hat 30. As an example, and as shown in the FIG. 6, the magnetic tapes may be attached at four attachment points (e.g., attachment point "1"-attachment point "4"). The device 10 can be installed in the hat 30 by attaching the first set of magnetic tapes 62*a* in the device 10 to the second set of magnetic tapes 62*b* in the hat 30.

In some embodiments, the second fastener 62 allows self-alignment of the device 10 with the attachment points in the hat 30. Since the two sets of magnetic tapes are of opposing polarities, they attract one another into the same aligned position with every attachment using mirrored positioning of the opposite poles (e.g., magnetic tapes attached on the device 10 and the hat 30 in the same pattern of attachment points) causing the device 10 to automatically self-align with the attachment points on the hat 30.

The magnetic tapes may be high-gauss magnetic tapes (e.g., gauss value above a specified threshold) that hold the device 10 firmly in position but also allow easy removability of the device 10 from the hat 30. The magnetic tapes may be attached to the device 10 and the hat 30 using an adhesive. In some embodiments, the adhesive may have very high permanent grip strength and be designed for use with synthetic fiber, fabric, and/or felted textile substrate.

In some embodiments, the dimensions of the two sets of magnetic tapes are different. As an example, and as illustrated in FIG. 6, the first magnetic tape on the device 10 ("attaching material") is of a shorter length than the opposing second magnetic tape ("attachment receptive material") (e.g., half the length of the first magnetic tape) applied inside the hat 30. In some embodiments, having the attaching material smaller than the attachment receptive material minimizes the damage that may be caused to the device 10 by the force with which the device 10 may be removed from the hat 30, thus enhancing removability of the device 10.

In some embodiments, the device 10 may be permanently attached to the headwear. As an example, a fastener such as an adhesive may be used to permanently attach the device 10 to the hat 30. In such embodiments, the device 10 may have an adhesive material on the away surface 53 (e.g., covering a portion or entirety of the away surface 53), which adheres the device 10 to the interior surface 34 in the crown portion 32 of the hat 30. The adhesive backing on the device 10 may be designed for use with synthetic fiber, fabric, and/or felted textile substrate. In some embodiments, the adhesion can be achieved using a double-sided tape in which one side of the tape is stuck to the away surface 53 of the device 10 and the other side of the tape is stuck to the interior surface 34 of the hat 30.

FIG. 7 shows a third fastener to install a device in a headwear permanently, consistent with various embodiments. The third fastener 72 may include sewing thread, which may be used to permanently attach the device 10 to headwear such as the hat 30 by sewing the device 10 to hat 30. The device 10 may be sewn at one or more attachment points on the interior surface 34 of the hat 30. As an example, and as shown in the FIG. 7, the device 10 is sewn to the hat 30 at five attachment points. The number of stitches at an attachment point may vary (e.g. based on the material of the hat 30 or the device 10). For example, as illustrated in FIG. 7, each attachment point may include up to four ("4") stitches.

In some embodiments, every stitch that penetrates the material of the hat 30 may create a direct wicking pathway for moisture to get into the hat 30, which may defeat the point of using the device 10 with the hat 30. Accordingly, this method of attachment relies on as few stitches as possible at as few attachment points as possible to maintain good retention of the device 10 within the crown portion 32 over time, while minimizing penetrative contact area with the material of the hat 30. In some embodiments, the stitching is performed in a specific way to minimize the penetrative contact area with the material of the hat 30. As an example, the depth of stitch from the hat 30 into the away surface 53 of the device 10 is ensured to be less than the thickness of the device 10 (e.g., not exceeding half of the thickness, or other depths) to keep moisture migration path away (e.g., sewing thread) from the head of the wearer. In other words, the stitching may be performed in such a way that the sewing thread does not reach the near surface, is not visible on the near surface, or is not in contact with the head of the wearer when the hat 30 is worn by the wearer.

While the foregoing paragraphs describe the use of different fasteners in different implementations, in some embodiments, a combination of fasteners may be used to attach the device 10 to the hat 30. As an example, magnets may be used at some attachment points and hook and loop fasteners may be used at other attachment points.

In some embodiments, the shape of the device 10 may be customized by the wearer. For example, a template may include a set of perforations for various shapes of devices.

Figure 8:
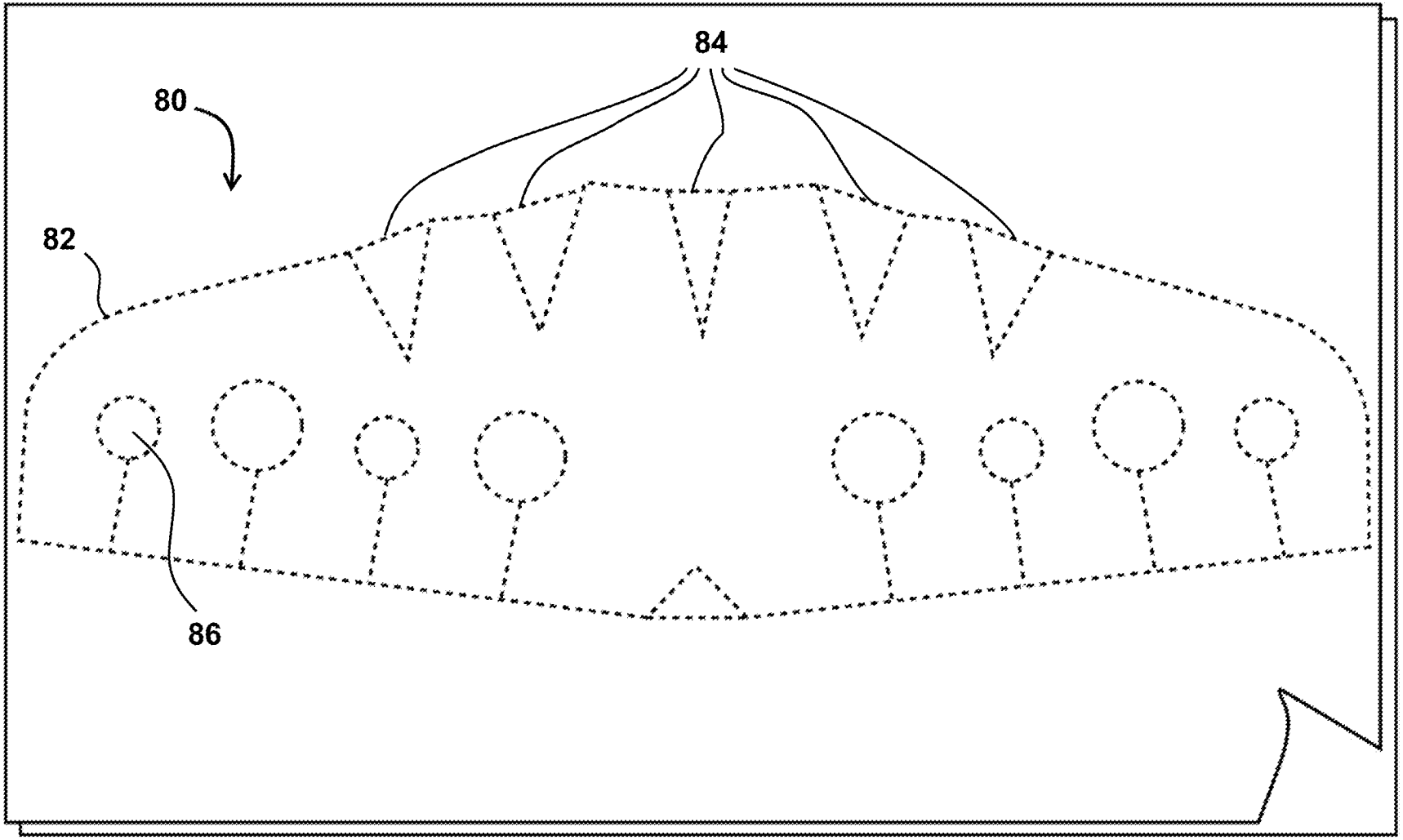
FIG. 8 shows a template with perforations for creating a device of a specific shape, consistent with various embodiments.

FIG. 8 shows a template 80 with perforations for creating a device of a specific shape, consistent with various embodiments. The wearer may cut (e.g., pick and pluck) along one or more perforations to create the device 10 of a specific shape. For example, the template 80 may be cut along all perforations to create the device 10 of FIG. 2. In another example, the template 80 may be cut along perforations 82 and 84 but not the other perforations to create a device with shaping notches similar to the shaping notches 16 and without any ventilation orifices. In another example, the template 80 may be cut along perforations 82 and one or more of perforations 86, but not the other perforations to create the device with one or more ventilation orifices but not the shaping notches. Various such templates with perforations for various designs can be created and used for creating devices of various shapes. In some embodiments, the shape of the device 10 may be customized using one or more templates (e.g., cut-to-fit template). For example, a blank device material of a uniform shape such as a square, rectangle or a circle may be shipped to a wearer and the wearer may create a device 10 of a specific shape using a template. The template is of a specific design and one or more such templates can be delivered to the wearer physically or digitally. For example, the templates may be provided with the device material, sold separately from the device 10, or provided via email or as website downloads (which may require the wearer to print the template on a paper). The wearer may cut the device material using a specific template to create the device 10 of a specific shape (e.g., wearer may superimpose the template on the device material and cut along the markings in the template).

Figure 9:
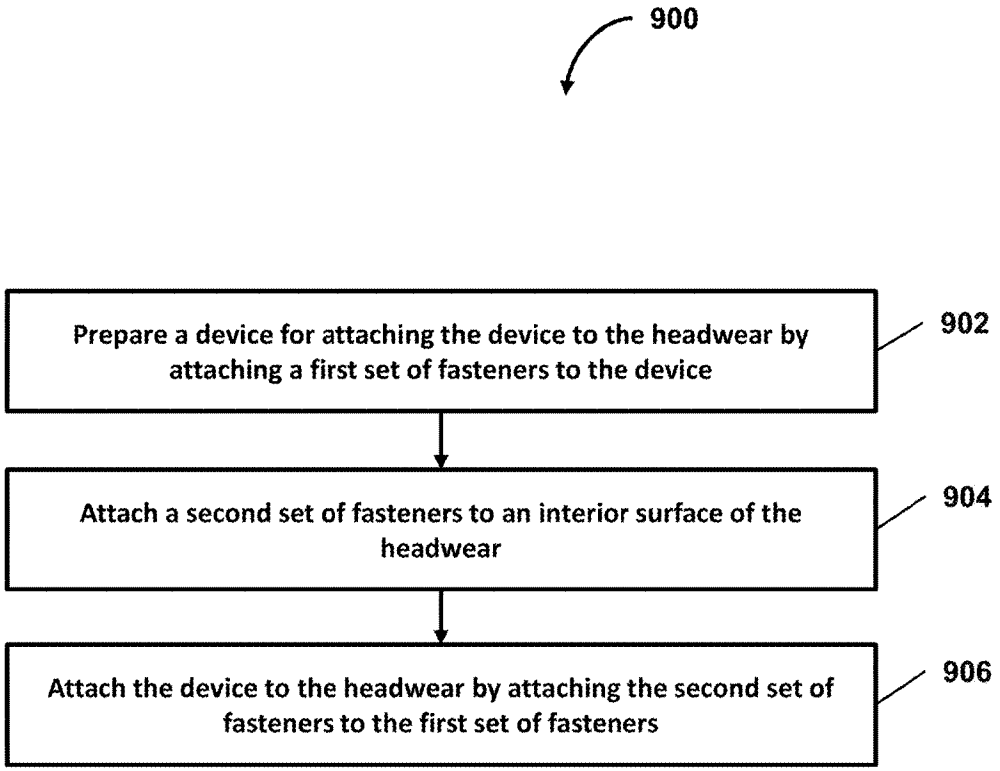
FIG. 9 shows a flowchart of a method for attaching a device to a headwear for shaping and protecting the headwear, consistent with various embodiments.

FIG. 9 is an example flowchart of processing operations of methods that enable the various features and functionality of the device as described in detail above. The processing operations of each method presented below are intended to be illustrative and non-limiting. In some embodiments, for example, the methods may be accomplished with one or more additional operations not described, and/or without one or more of the operations discussed. Additionally, the order in which the processing operations of the methods are illustrated (and described below) is not intended to be limiting.

FIG. 9 shows a flowchart of a method 900 for attaching a device to a headwear for shaping and protecting the headwear, consistent with various embodiments. In some embodiments, the method 900 for attaching a device to a headwear, such as the device 10 to the hat 30, may include the steps of preparing the device 10 for attachment to the hat 30 (902), attaching a fastener to the hat 30 (904), and attaching the device 10 to the hat 30 (906). The first step (902) of preparing the device 10 may include one or more actions. For example, a first action may include creating a device of a specific shape (e.g., device 10) from a template (e.g., as described at least with reference to FIG. 8). In some embodiments, the first action may be optional. For example, if the device is already created customized to a specific shape, the wearer may not have to perform the first action. A second action in preparing the device 10 for attachment to the hat 30 may include attaching a first set of fasteners (fastener examples are mentioned at least with reference to FIGS. 5-7) to the device 10. In some embodiments, the first set of fasteners can be attached to the device 10 as described at least with reference to FIGS. 5-7. In some embodiments, the device 10 may include markers for the attachment points, which may help the wearer in locating the attachment points for attaching the first set of fasteners. In some embodiments, the markers for attachment points may be provided on a separate marker template, which the wearer may use for locating the attachment points (e.g., by superimposing the marker template on the device 10 to locate the attachment points). In some embodiments, the second action may be optional. For example, if the device already has the first set of fasteners attached to it, the wearer may not have to perform the second action.

The second step (904) of attaching the fastener to the hat 30 may include attaching a second set of fasteners to the hat 30 at one or more attachment points. In some embodiments, the second set of fasteners can be attached to the hat 30 as described at least with reference to FIGS. 5-7. In some embodiments, a marker template having markers for the attachment points may be provided, which the wearer can use to locate the attachment points on the hat 30 for attaching the second set of fasteners. In some embodiments, the marker template may be the same marker template used for locating the attachment points on the device 10. In an another example, the second set of fasteners may be attached to the hat 30 by first attaching them to the first set of fasteners of the device 10 (e.g., loop material to be attached to the hat 30 can be attached to the hook material attached to the device 10), peeling of a back covering layer of the first set of fasteners to expose an adhesive layer on the back of the first set of fasteners, aligning the device 10 with the attachment points on the interior surface of the hat 30 and then pressing the device 10 against the attachment points to attach the second set of fasteners to the hat 30.

After the fasteners are attached to the device 10 and hat 30, in the third step (906), the device 10 can be attached to the hat 30 by aligning the first set of fasteners on the device 10 with the second set of fasteners on the hat 30 and attaching the first set of fasteners on the device 10 to the second set of fasteners on the hat 30.

To remove the device 10 from the hat 30, the device 10 may be detached by pulling the device 10 (e.g., from one of the corners of the device 10, preferably proximate an attachment point) away from the hat 30. The wearer may easily use the device 10 with another hat (e.g., using the second step (904) and third step (906) if the other hat does not have fasteners attached to it, or using the third step (906) if the other hat already has fasteners attached to it).

In some embodiments, headwear may be made available to a wearer with a device, such as the device 10, attached to or included with the headwear. The wearer may use the device with the headwear or detach the device 10 from the headwear and use it with another headwear.

The above-described embodiments presented for purposes of illustration and not of limitation. While these embodiments have been described with reference to numerous specific details, one of ordinary skill in the art will recognize that the disclosed embodiments can be embodied in other specific forms. Thus, one of ordinary skill in the art would understand that the disclosed embodiments are not to be limited by the foregoing illustrative details, but rather is to be defined by the appended claim.

The present techniques will be better understood with reference to the following enumerated embodiments:

1. An insert for shaping or protecting a headwear, the insert comprising:
   - an elongate body shaped to install along an interior surface of a crown portion of the headwear, wherein the elongate body includes a plurality of ventilation orifices extending through the elongate body; and
   - a set of fasteners to install the insert to the headwear, wherein the set fasteners are attached to the insert and the interior surface of the headwear at one or more attachment points, wherein the set of fasteners include at least one of a set of hook and loop fasteners or a set of magnetic fasteners.

2. The insert of embodiment 1, wherein the set of hook and loop fasteners includes a set of hooks that is to be attached to a first surface of the elongate body, and wherein the set of hook and loop fasteners includes a set of loops that is to be attached on the interior surface of the headwear, wherein the set of hooks attaches to the set of loops for fitting the insert along the interior surface of the headwear.

3. The insert of embodiment 1, wherein the headwear is a hat, and wherein the insert is positioned in a crown portion of the hat that will be in contact with a forehead of a wearer of the hat, wherein the device is positioned in the crown portion such that a bottom edge of the elongate body is in contact with a band of the hat in a bottom portion of the interior surface of the hat.

4. An insert for a headwear, the insert comprising:

an elongate body shaped to fit along an interior surface of a crown portion of the headwear, wherein the elongate body includes at least one ventilation orifice extending through the elongate body, wherein the at least ventilation orifice includes a slit that extends from the at least ventilation orifice to an edge of the elongate body; and a fastener to detachably fit the insert to the headwear.

5. The insert of embodiment 4, wherein the headwear is a hat, and the insert is positioned in the crown portion of the hat that will be in contact with a forehead of a wearer of the hat.

6. The insert of embodiment 5, wherein the insert is positioned in the crown portion of the hat such that a bottom edge of the elongate body is in contact with a band of the hat in a bottom portion of the interior surface of the hat.

7. The insert of embodiment 4, wherein the elongate body is of a thickness in a range of 1/32 of an inch to 1/8 of an inch.

8. The insert of embodiment 4, wherein the elongate body further includes a set of perforations, wherein the elongate body is configured to be cut along the set of perforations to create the insert of a specified shape.

6. The insert of embodiment 4 further comprising:

a template of a specified shape, wherein the elongate body is configured to be cut to the specified shape using the template.

What is claimed is:

1. A device for shaping and protecting a headwear, the device comprising:

an elongate body shaped to fit along an interior surface of the headwear, wherein the elongate body includes at least one ventilation orifice extending through the elongate body, wherein the elongate body is made substantially of an absorptive compacted fibrous material, wherein the at least ventilation orifice includes a slit that extends from the at least ventilation orifice to an edge of the elongate body, and wherein the elongate body includes one or more tabs created by slits of ventilation orifices, and wherein the one or more tabs are configured to be placed inside an interior band of the headwear.

2. The device of claim 1, wherein the absorptive compacted fibrous material includes at least one of pressed wool felt or needled wool felt.

3. The device of claim 2, wherein the absorptive compacted fibrous material further includes one or more of merino wool, synthetic wool, blended fire-retardant fibers, silver fibers, bamboo fibers, synthetic fibers, or blends of one or more fibers.

4. The device of claim 1, wherein the absorptive compacted fibrous material includes one or more of merino wool, synthetic wool, blended fire-retardant fibers, silver fibers, bamboo fibers, synthetic fibers, or blends of one or more fibers.

5. The device of claim 1, wherein the absorptive compacted fibrous material is fire resistant and compliant with one or more of Restriction of Hazardous Substances (ROHS), a federally mandated motor vehicle safety standard for fibers, American Society for Testing and Materials (ASTM), International Organization for Standardization (ISO), or National Fire Protection Association (NFPA) standards.

6. The device of claim 1, wherein the absorptive compacted fibrous material includes a woven material.

7. The device of claim 1 further comprising:

a fastener to fit the device to the headwear.

8. The device of claim 7, wherein the fastener is configured to detachably fit the device to the headwear.

9. The device of claim 8, wherein the fastener includes a first portion that is attached to the device and a second portion that is attached to the interior surface of the headwear, and wherein the first portion is attached to the second portion to fit the device to the headwear.

10. The device of claim 8, wherein the fastener is attached to the device and the interior surface of the headwear at one or more attachment points of the device and the headwear.

11. The device of claim 8, wherein the fastener is attached to the interior surface of the headwear and the device by at least one of stitching or using an adhesive.

12. The device of claim 8, wherein the fastener includes:

a set of hook and loop fasteners to fit the device along the interior surface of the headwear.

13. The device of claim 12, wherein the set of hook and loop fasteners includes a set of hooks that is to be attached to a first surface of the elongate body, and wherein the set of hook and loop fasteners includes a set of loops that is to be attached on the interior surface, wherein the set of hooks attaches to the set of loops for fitting the device along the interior surface of the headwear.

14. The device of claim 13, wherein the set of hooks is attached to the device at one or more portions of the elongate body on the first surface.

15. The device of claim 13, wherein the set of loops is attached to the interior surface at one or more portions of the interior surface of the headwear.

16. The device of claim 13, wherein at least one hook from the set of hooks is of a smaller dimension than a loop from the set of loops the at least one hook attaches to.

17. The device of claim 7, wherein the fastener includes:

a magnetic tape and a metal tape that is attracted to the magnetic tape to fit the device along the interior surface of the headwear.

18. The device of claim 17, wherein one of the magnetic tape and the metal tape is attached to a first surface of the elongate body and another one of the magnetic tape and the metal tape is attached to the interior surface of the headwear.

19. The device of claim 7, wherein the fastener includes:

a first magnetic tape of a first polarity and a second magnetic tape of a second polarity opposite the first polarity, wherein the first magnetic tape is attached to the second magnetic tape to fit the device to the headwear.

20. The device of claim 19, wherein one of the first magnetic tape and the second magnetic tape is attached to a first surface of the elongate body and another one of the first magnetic tape and the second magnetic tape is attached to the interior surface of the headwear.

21. The device of claim 20, wherein the one of the first magnetic tape and the second magnetic tape is attached to the first surface of the elongate body at one or more points in a specified pattern, and wherein the another one of the first magnetic tape and the second magnetic tape is attached to the interior surface of the headwear at one or more points in the same specified pattern to cause the device to automatically align with the one or more points of the interior surface of the headwear.

22. The device of claim 7, wherein the fastener includes an adhesive that is used to fit the device to the headwear.

23. The device of claim 7, wherein the fastener includes sewing thread, and wherein the device is stitched to the interior surface of the headwear using the sewing thread.

24. The device of claim 23, wherein the sewing thread penetrates the elongate body from a first surface of the elongate body to a portion of the thickness of the elongate body such that the sewing thread is not visible on a second surface of the elongate body, the first surface facing the interior surface and the second surface facing away from the interior surface.

25. The device of claim 1, wherein the elongate body is of a thickness in a range of 1/32 of an inch to 1/8 of an inch.

26. The device of claim 1, wherein the elongate body further includes a set of perforations, wherein the elongate body is configured to be cut along the set of perforations to create the device of a specified shape.

27. The device of claim 1 further comprising:

a template of a specified shape, wherein the elongate body is configured to be cut to the specified shape using the template.

* * * * *